United States Patent [19]

Lisec

[11] Patent Number: 4,781,878

[45] Date of Patent: Nov. 1, 1988

[54] METHOD FOR PRODUCING AND SEALING AN OPENING IN A HOLLOW MOLDING

[76] Inventor: Peter Lisec, Bahnhofstrasse 34, A-3363 Amstetten-Hausmening, Austria

[21] Appl. No.: 65,579

[22] Filed: Jun. 23, 1987

[30] Foreign Application Priority Data

Mar. 9, 1987 [AT] Austria ..... 550/87

[51] Int. Cl.[4] ..... E06B 3/24

[52] U.S. Cl. ..... 264/267; 156/107; 156/109; 52/171; 52/172; 52/788; 52/790

[58] Field of Search ..... 156/109, 107, 94, 292, 156/295, 252, 79; 52/171, 172, 788, 798, 743, 514; 152/370; 264/267, 36

[56] References Cited

U.S. PATENT DOCUMENTS

| | | | |
|---|---|---|---|
| 4,049,480 | 9/1977 | Kutschke | 156/94 |
| 4,284,450 | 8/1981 | Duttlinger | 152/370 X |
| 4,670,954 | 6/1987 | Lisec | 29/33 K |

FOREIGN PATENT DOCUMENTS

| | | | |
|---|---|---|---|
| 0195176 | 9/1986 | European Pat. Off. | 52/172 |
| 2351028 | 4/1975 | Fed. Rep. of Germany | 52/790 |
| 8519191 | 10/1985 | Fed. Rep. of Germany . | |
| 0560000 | 3/1944 | United Kingdom | 156/109 |

*Primary Examiner*—Michael W. Ball
*Assistant Examiner*—Jeff H. Aftergut
*Attorney, Agent, or Firm*—Young & Thompson

[57] ABSTRACT

A method is described wherein at least one opening (6) is produced in a wall (2) of a hollow molding (1), with the formation of a shoulder (9) surrounding the opening (6) and projecting into the interior (8) of the hollow molding (1). A plug (12) of a sealing compound (11) is produced for sealing the opening (6), or the opening (6) in the wall (2) and a further opening (7) in the opposite wall (3) of the hollow molding (1), this plug being securely retained in the interior (8) of the hollow molding (1) by the feature that the plug extends into the space (16) defined by the shoulder (9) and rests on the inner surface (13) of the opposite wall (3) of the hollow molding (1).

6 Claims, 1 Drawing Sheet

METHOD FOR PRODUCING AND SEALING AN OPENING IN A HOLLOW MOLDING

Figure 1:
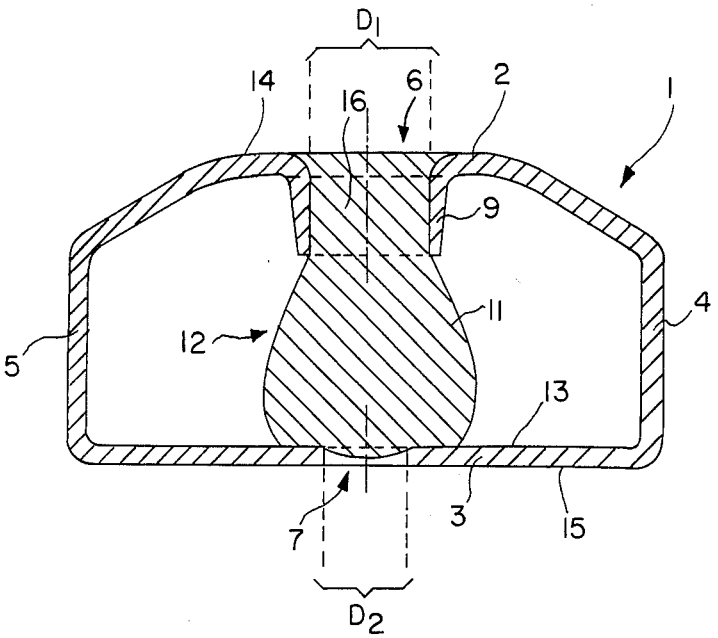

The invention relates to a method for the production and subsequent sealing of an opening in a hollow molding, especially a hollow molding intended to serve as a spacer for an insulating glass pane, wherein an opening is produced in at least one of the mutually opposed walls of the hollow molding and the opening is sealed by introducing a sealing compound that is in the plastic condition at the instant of introduction.

In the manufacture of insulating glass panes, the problem is encountered, for example when filling hollow moldings constituting the spacer frame with a desiccant, of producing in the outer wall of the hollow molding at least one opening through which then a desiccant (molecular sieve) can be introduced. This opening in the hollow molding must be resealed after the desiccant has been introduced. This is described, for example, in DE-U Pat. No. 85 19 191.

Also when filling insulating glass blanks with a filling gas, e.g. sulfur hexafluoride ($SF_6$), the hollow molding constituting the spacer frame must ordinarily be pierced at two locations in order to introduce the filling gas into the interior of the insulating glass blank. Likewise, when filling insulating glass blanks with a filling gas, the openings in the hollow molding required for the filling step must then be resealed.

Heretofore, the aforedescribed openings in hollow moldings have been sealed either by riveting of the opening, or by the introduction of a plug made of a sealing compound (compare DE-U Pat. No. 85 19 191).

It has also been proposed to indent the wall of the hollow molding in the zone of the opening in order to improve the retention of the sealing compound. However, this suggestion likewise results in an inadequate retention of the plug of sealing compound, which has the shape of a flat truncated cone.

It has been found, however, that the conventional plugs of sealing compound are only poorly retained in the openings because, in particular, the hollow moldings used for spacers of insulating glass panes exhibit an only very small wall thickness (less than 1 mm, for example 0.4 mm). Therefore, it has happened frequently that the sealing compound does not entirely seal off the opening that is to be closed off, or recedes again from the opening during subsequent working steps for finishing the insulating glass pane.

The invention is based on the object of providing a method of the type discussed hereinabove, making it possible to effect a reliable and simple sealing of openings in hollow moldings. Furthermore, the method is to be performable in a maximally simple way.

According to the invention, this object has been attained by forming a shoulder having an essentially cylindrical-shell configuration at least in one wall of the hollow molding, this shoulder surrounding the opening in this wall concentrically and projecting into the interior of the hollow molding, and by filling the space defined by the shoulder with sealing compound during the sealing of the opening.

Due to the fact that, according to this invention, a shoulder is formed surrounding the opening in the wall of the hollow molding, a larger depth of the opening is obtained so that the plug of sealing compound is securely retained in the opening.

Preferably, the method of this invention is performed by producing, during introduction of the sealing compound, a plug of sealing compound, preferably having an approximately pear-shaped configuration, this plug extending from the opening with the shoulder to the opposte wall of the hollow molding and resting on the inner surface of the opposite wall. By following this procedure, the plug sealing the opening is additionally supported on the wall of the hollow molding lying oppositely to the opening, thus attaining an even firmer seating of the sealing plug made up of sealing compound.

An especially advantageous version of the method of this invention is characterized by forming the shoulder surrounding the opening simultaneously with the production of the opening. This can be achieved, for example, by producing the opening in the wall by piercing with an awl-type tool or by counterboring, rather than by a cutting-type drilling step, so that the shoulder is formed simultaneously with the production of the opening from the wall material deformed into the interior of the hollow molding.

Especially in cases where openings are to be produced in hollow moldings constituting spacer frames through which a filling gas can be introduced into the interior of an insulating glass blank, it is recommended within the scope of this invention to follow a procedure wherein an opening is produced also in the wall of the hollow molding lying in opposition to the opening having the shoulder; the diameter of this other opening is preferably smaller than the diameter of the opening with the shoulder.

This opening in the inner wall of the spacer frame will usually be formed without a shoulder so that the visible wall of the hollow molding remains planar. However, if it is intended to provide an especially secure seating of the plug of sealing compound, then it is also possible according to this invention to form an outwardly projecting shoulder having essentially the shape of a cylindrical shell and surrounding the opening lying in opposition to the opening with the shoulder, and to fill, during introduction of the sealing compound, also the space defined by this shoulder at least partially with sealing compound. In this connection, it is also advantageous to form the shoulder surrounding this (second) opening simultaneously with the production of the opening proper.

The invention also includes the feature that the sealing compound, after introduction thereof, is finished by smoothing so that it terminates substantially flush with the outer surface of the hollow molding. This provides the result that the sealing compound does not extend past the outer surface of the hollow molding and does not impede the subsequent filling of the edge joints of an insulating glass blank with a caulking medium.

Figure 2:
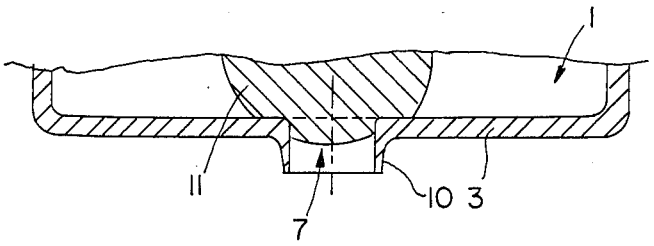

Additional features and details of the method of this invention will be described below with reference to the drawing wherein:

FIG. 1 shows a cross section through a hollow molding with openings sealed according to this invention, and FIG. 2 shows a modified embodiment.

A hollow molding 1, manufactured, for example, of aluminum or of an aluminum alloy by extrusion or rolling, comprises a wall 2 which comes to lie on the outside when the molding is used as a spacer, a wall 3 lying in opposition to this wall, and two sidewalls 4 and 5 joining the walls 2 and 3.

When intending to fill the interior 8 of the hollow molding 1 with a desiccant (molecular sieve), an opening 6 is produced (compare DE-U Pat. No. 81 19 191) in the wall 2 of the hollow molding 1 which has been bent into a spacer frame for insulating glass panes as described, for example, in DE-C Pat. No. 3 223 881. The opening 6 is formed, for example, by piercing the wall 2, or by counterboring, so that a shoulder 9 projecting into the interior 8 of the hollow molding 1 is produced simultaneously with the formation of the opening 6 in the wall 2. The shoulder 9 extends all around the opening 6 and has a shape that is essentially that of a cylindrical shell.

When intending to drill through a hollow molding 1, installed as a spacer in an insulating glass blank, in order to fill the interior of the insulating glass blank with a filling gas (e.g. sulfur hexafluoride), then an opening 7 is also produced in the wall 3 lying in opposition to the wall 2 (on the inside). As shown in the drawing, the opening 7 preferably has a diameter $D_2$ smaller than the diameter $D_1$ of the opening 6.

The opening 7 can be formed without a shoulder or, as shown in FIG. 2, can likewise have a shoulder 10 which does not project into the interior 8 of the hollow molding 1 but rather toward the outside away from this molding.

Once, for example, filling of the inner space 8 of the hollow molding 1 with a desiccant or filling of the inner space of an insulating glass blank with a filling gas has been finished, the opening 6 is, or the openings 6 and 7 are, closed off by means of a sealing compound 11 which is in the plastic condition during introduction. Suitable as a sealing compound is, for example, a composition as it is also utilized as a caulking agent for filling the edge joints of insulating glass panes (sealing of insulating glass panes). For example, it is possile to use a sealing compound based on "Thiokol".

The sealing compound 11 is introduced through the opening 6 in the wall 2 and forms a plug 12 having, in the illustrated embodiment, an outwardly bulging, approximately pear-shaped form extending from the opening 6 up to the opposite wall 3, sealing the opening 7, and resting on the inner surface 13 of the wall 3.

After the sealing compound 11 for sealing the openings 6 and 7 has been introduced, it can be additionally smoothed over so that it terminates flush with the outer surface 14 of the wall 2 of the hollow molding 1, as shown in FIG. 1. This smoothing step can be combined, for example, with the moving away of a nozzle (not illustrated) used for introducing the sealing compound 11. In this connection, the nozzle is moved laterally, with a simultaneous turning motion, away from the opening 6, and is only thereafter lifted off the wall 2. During this movement, the skein of sealing compound 11 extending from the nozzle into the opening 6 is severed.

If a shoulder 10 has been formed in the zone of the opening 7, then the sealing compound 11 partially fills the space defined by the shoulder 10.

If only one opening 6 has been produced in the wall 2 in the hollow molding 1, and no opening 7 has been formed in the wall 3, as is the case when filling hollow moldings 1 with a desiccant, then it is sufficient merely to fill the space 16 defined by the collar 9 at least partially with sealing compound 11. However, ordinarily it is preferred to introduce such a quantity of sealing compound 11 that a plug 12 is formed extending up to the wall 3 and resting on the inner surface 13 of the latter, since thereby an improved seating of the plug 12 of sealing compound 11 is obtained.

What is claimed is:

1. A method for production and subsequent sealing of an opening in a hollow molding of closed cross-sectional configuration having a pair of opposite side walls, comprising forming in one of said opposite side walls said opening surrounded by a substantially cylindrical shoulder that extends toward but terminates short of the other of said pair of side walls, and introducing through said opening a sealing compound which is in a plastic condition at a time of introduction, until the sealing compound contacts said other side wall and spreads out to form, between said other side wall and said cylindrical shoulder, a plug whose diameter is greater than an internal diameter of said cylindrical shoulder, said plug being out of contact with side walls of said hollow molding other than said pair of opposite side walls.

2. A method as claimed in claim 1, in which said plug is of pear-shaped configuration.

3. A method as claimed in claim 1, and producing an opening in said other side wall in axial alignment with said cylindrical shoulder, and filling the latter opening also with said sealing compound that has been introduced through the first-mentioned opening.

4. A method as claimed in claim 3, said opening in said other wall having a diameter less than the internal diameter of said cylindrical shoulder.

5. A method as claimed in claim 3, and producing on said other wall a substantially cylindrical shoulder surrounding said latter opening and extending in a direction away from said other wall.

6. A method as claimed in claim 1, and after introducing the sealing compound, smoothing the sealing compound so that it terminates flush with an outer surface of the hollow molding.

* * * * *